US007750762B2

(12) United States Patent
Okano

(10) Patent No.: US 7,750,762 B2
(45) Date of Patent: Jul. 6, 2010

(54) WAVEGUIDE CORNER AND RADIO DEVICE

(75) Inventor: Takeshi Okano, Omihachiman (JP)

(73) Assignee: Murata Manufacturing Co., Ltd., Nagaokakyo-shi, Kyoto-fu (JP)

( * ) Notice: Subject to any disclaimer, the term of this patent is extended or adjusted under 35 U.S.C. 154(b) by 281 days.

(21) Appl. No.: 10/586,480

(22) PCT Filed: Mar. 9, 2005

(86) PCT No.: PCT/JP2005/004059

§ 371 (c)(1),
(2), (4) Date: Jul. 18, 2006

(87) PCT Pub. No.: WO2005/099026

PCT Pub. Date: Oct. 20, 2005

(65) Prior Publication Data

US 2008/0238579 A1 Oct. 2, 2008

(30) Foreign Application Priority Data

Mar. 30, 2004 (JP) ..... 2004-100046

(51) Int. Cl.
*H01P 1/02* (2006.01)
*H01P 1/165* (2006.01)

(52) U.S. Cl. ..... 333/249; 333/21 A

(58) Field of Classification Search ..... 333/21 R, 333/21 A, 249, 125, 127, 135, 137
See application file for complete search history.

(56) References Cited

U.S. PATENT DOCUMENTS 2,854,637 A 9/1958 Zaleski
2,860,309 A * 11/1958 Zaleski ..... 333/137
6,563,398 B1 * 5/2003 Wu ..... 333/137
2002/0000892 A1 * 1/2002 Schubert et al. ..... 333/21 A
2002/0021184 A1 2/2002 Rosenberg et al.

FOREIGN PATENT DOCUMENTS

| | | |
|---|---|---|
| EP | 0351514 | 1/1990 |
| FR | 2057237 | 4/1971 |
| JP | 55-104803 | 7/1980 |
| JP | 04-257101 | 9/1992 |
| JP | 05-048309 | 2/1993 |
| JP | 06-085502 | 3/1994 |
| JP | 07-046011 | 2/1995 |
| JP | 9-246801 | 9/1997 |
| JP | 10-051208 | 2/1998 |

OTHER PUBLICATIONS

International Search Report PCT/JP2005/004059 dated May 24, 2005.
Written Opinion PCT/JP2005/004059 dated May 24, 2005.

* cited by examiner

*Primary Examiner*—Benny Lee
*Assistant Examiner*—Gerald Stevens
(74) *Attorney, Agent, or Firm*—Dickstein, Shapiro, LLP.

(57) ABSTRACT

A waveguide corner including a first rectangular waveguide and a second rectangular waveguide. An end face of the second rectangular waveguide is made open to an H-plane wall of the first rectangular waveguide and the H-plane walls of the second rectangular waveguide are disposed along the pipe axis of the first rectangular waveguide. Accordingly, planes of polarization of electromagnetic waves being propagated in the first and second rectangular waveguides are made perpendicular to each other.

8 Claims, 11 Drawing Sheets

WAVEGUIDE CORNER AND RADIO DEVICE

FIELD OF THE INVENTION

The present invention relates to a waveguide corner connected to a primary radiator of a radio device, etc., for example, and having two waveguides connected in a bent state and a radio device using the waveguide corner.

BACKGROUND OF THE INVENTION

In general, among waveguide corners, the H-corner and E-corner in which a rectangular waveguide is bent, for example, are known (see Non-Patent Document 1, for example). At this time, since the H-corner is bent so as to be parallel to a magnetic field H, the H-plane wall constituting the long side of a rectangular waveguide is bent 90 degrees. On the other hand, since the E-corner is bent so as to be parallel to an electric field E, the E-plane wall constituting the short side of a rectangular waveguide is bent 90 degrees.

Non-Patent Document 1: "Maikuroha-kairo no kiso to sono oyo (Basics and Applications of Microwave Circuit)", Yoshihiro Konishi, Sogo-denshi-shuppansha, Aug., 1990, p 181

Now, in the above-described H-corner according to a related technology, since the H-plane wall is bent, although the plane of polarization of an electric field E is perpendicular to each other between the input side and the output side of the H-corner, the rectangular waveguide can be bent only in the direction parallel to the H-plane wall (direction perpendicular to the E-plane wall). On the other hand, since the E-plane wall is bent in the E-corner, although the rectangular waveguide can be bent in the direction perpendicular to the E-plane wall, the plane of polarization of an electric field E becomes parallel to each other between the input side and the output side of the H-corner, the plane of polarization cannot be freely selected. As a result, according to the related technology, the freedom of layout of a waveguide microwave circuit in which a plurality of waveguides are combined is low and there is a problem in that the waveguide circuit becomes larger.

SUMMARY OF THE INVENTION

The present invention has been made in consideration of the above-described problem of the related technology, and it is an object of the present invention to provide a waveguide corner and radio device in which the degree of freedom of layout of a waveguide circuit is increased and the waveguide circuit can be made smaller.

In order to solve the above-described problem, according to the present invention, a waveguide corner has one waveguide and another waveguide connected in a bent state. Each of the waveguides comprises a pair of first walls, opposite to each other, having a long longitudinal dimension perpendicular to a pipe axis, and a pair of second walls having a short transverse dimension perpendicular to the pipe axis. The pair of second walls is positioned at both ends of the first walls and connects the pair of first walls. In the waveguide corner, an end face of the other waveguide is made open to a first wall of the one waveguide, and a first wall of the other waveguide extends along the pipe axis of the one waveguide.

According to the present invention, since a first wall of one waveguide is made open for an end face of the other waveguide, the other waveguide can be connected in the direction perpendicular to the first wall of the one waveguide, for example. Furthermore, since the first and second walls extend in the direction perpendicular to the pipe axis and at the same time, a first wall of the other waveguide extends along the pipe axis of the one waveguide, the first wall of the other waveguide can be extended in the direction perpendicular to the extending direction of the first wall of the one waveguide. Accordingly, since a plane of polarization of the one waveguide and a plane of polarization of the other waveguide can be made perpendicular to each other, the conversion function of a plane of polarization can be made available. Furthermore, since the first walls of the two waveguides form different planes, the other waveguide can be extended in a direction perpendicular to the first wall of the one waveguide. As a result, the degree of freedom of layout of a waveguide circuit is increased and the waveguide can be made smaller.

In the present invention, each of the waveguides is a rectangular waveguide being rectangular in section, the rectangular waveguide contains an H-plane wall parallel to a magnetic field constituting a first wall and an E-plane wall parallel to an electric field constituting a second wall, an end face of the other rectangular waveguide is made open to the H-plane wall of the one rectangular waveguide, and the H-plane walls of the other rectangular waveguide may extend along the pipe axis of the one rectangular waveguide.

Because of such a structure, for example, electric-field components are made perpendicular to each other, and, while the conversion function of a plane of polarization is made available, the other rectangular waveguide can be extended in a direction perpendicular to the H-plane wall of the one rectangular waveguide. As a result, the degree of freedom of layout of a waveguide circuit is increased and the waveguide can be made smaller.

In the present invention, the central axis of the E-plane wall of the other rectangular waveguide may be disposed so as to be displaced from the central axis of the H-plane wall of the one rectangular waveguide.

According to the present invention, since an end face of the other rectangular waveguide is made open to the H-plane wall of the one rectangular waveguide, one H-plane wall constituting the other rectangular waveguide is disposed at a position close to the central axis of the H-plane wall of the one rectangular waveguide and the other (remaining) H-plane wall can be disposed at a position away from the central axis of the H-plane wall of the one rectangular waveguide. Then, in an area where the two rectangular waveguides overlap (area where the other rectangular wave guide is made open to the one rectangular waveguide), an electric field is directed so as to be perpendicular to one side, which is close to the central axis of the H-plane wall of the one rectangular waveguide, among the four sides constituting the open end face of the other rectangular waveguide. The direction of the electric field is a composite direction of electric fields of modes being propagated in the rectangular waveguides and thus, the conversion of a plane of polarization becomes possible. As a result, the conversion of a plane of polarization between two rectangular waveguides is performed and the electric-field components can be made perpendicular to each other between one rectangular waveguide and the other rectangular waveguide.

In the present invention, the H-plane wall of the other rectangular waveguide may be formed so as to be the same plane as the E-plane wall of the one rectangular waveguide.

According to the present invention, since the H-plane wall of the other rectangular waveguide is constituted so as to be the same plane as the E-plane wall, out of the two H-plane walls of the other rectangular waveguide, the other H-plane wall is made continuous with the E-plane wall of the one rectangular waveguide and the one H-plane wall can be disposed in the vicinity of the central axis of the H-plane wall of the one rectangular waveguide. Then, in an area where the two rectangular waveguides overlap (area where the other rectangular waveguide is made open to the one rectangular waveguide), an electric field is directed so as to be perpendicular to a side close to the central axis of the H-plane wall of the one rectangular waveguide out of the four sides constituting the open end face of the other rectangular waveguide. The direction of the electric field is a composite direction of the waves being propagated in the rectangular waveguides and thus, the conversion of a plane of polarization becomes possible. As a result, the conversion of a plane of polarization is performed between the two rectangular waveguides and the electric-field components can be made perpendicular to each other between one rectangular waveguide and the other rectangular waveguide. Furthermore, since the H-plane wall of the other rectangular waveguide is constituted so as to be the same plane as the E-plane wall of the one rectangular waveguide, the H-plane wall of the other rectangular waveguide and the E-plane wall of the one rectangular waveguide can be formed at the same time, and the moldability and productivity can be increased.

In the present invention, a matching waveguide element may be contained in the one waveguide, and the matching waveguide element is positioned in the vicinity of the open end face of the other waveguide so as to match electromagnetic modes to each other.

When two modes having two different planes of polarization are converted to each other between the two waveguides, there is a tendency that mismatch occurs between the two modes. In the present invention, however, since a matching waveguide element is contained in the vicinity of an open end face of the other waveguide, the matching between the two modes is improved by making the matched frequency band wider by using the matching waveguide element and the reflection loss can be reduced between the two waveguides.

In the present invention, the matching waveguide element may be constituted by a conductor protrusion portion protruded inside the one waveguide.

Because of such a structure, for example, the matching between modes in two waveguides can be increased by concentrating an electric field at the tip side of the conductor protrusion portion. Furthermore, since the matching waveguide element is constituted by a conductor protrusion portion, the conductor protrusion portion can be simultaneously formed when the wall of a waveguide is processed, and the processability and efficiency of mass production can be increased.

Furthermore, in the present invention, a radio device may be constituted by using a waveguide corner of the present invention.

Thus, a waveguide corner in which the conversion of a plane of polarization is possible can be applied to a connection portion of a radiator of a radio device, etc., for example, and, as a result, the degree of freedom of layout of a radio device is increased and the device can be made smaller as a whole.

REFERENCE NUMERALS

1 and 11 waveguide corners

2, 4, 12, 14, and 14' rectangular waveguides

2A, 2B, 4A, 4B, 12A, 12B, 14A, 14B, 14A', and 14B' H-plane walls

2C, 2D, 4C, 4D, 12C, 12D, 14C, 14D, 14C', and 14D' E-plane walls

3 and 13 terminal walls

5, 15, and 15' openings

21 conductor protrusion portion (matching waveguide element)

31 radar device

41, 42, and 43 waveguides

41A, 41B, 42A, 42B, 43A, and 43B first walls

41C, 41D, 42C, 42D, 43C, and 43D second walls

DETAILED DESCRIPTION OF THE INVENTION

Hereinafter, a waveguide corner and a radio device according to preferable embodiments of the present invention are described in accordance with the accompanied drawings.

Figure 1:
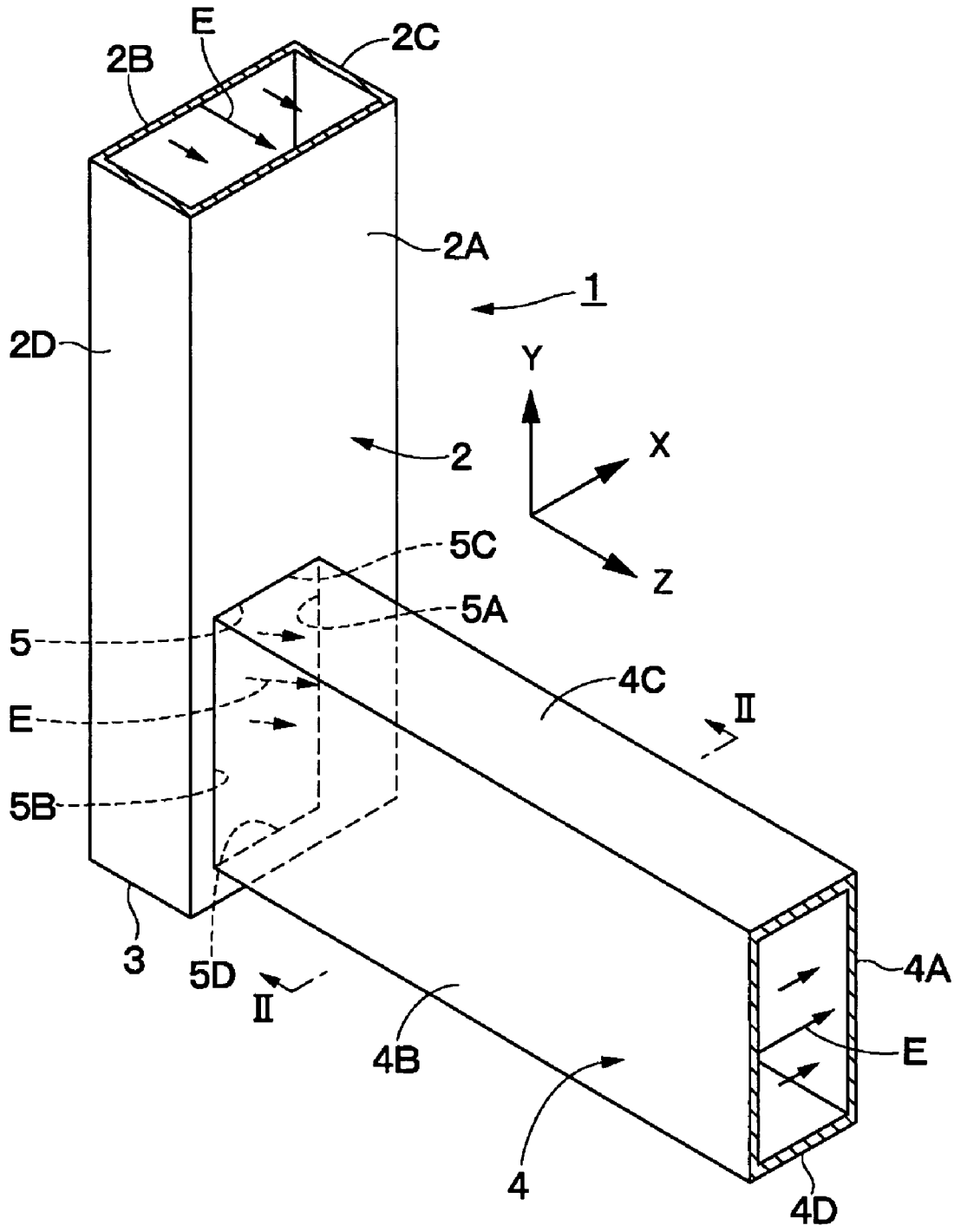
FIG. 1 is a perspective view showing a waveguide corner according to a first embodiment.
Figure 2:
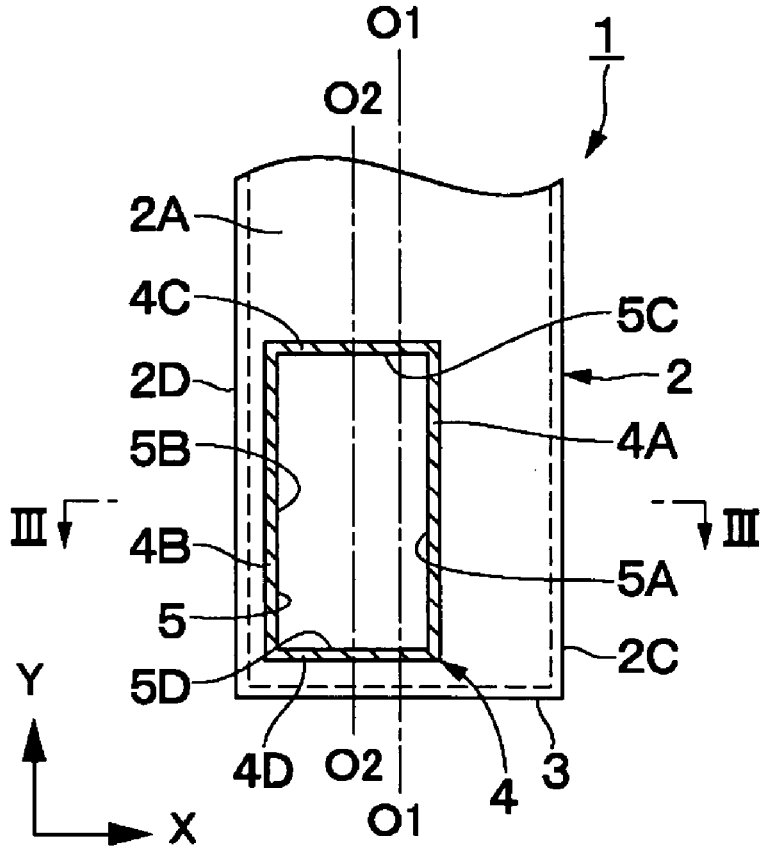
FIG. 2 is a sectional view taken on line II-II of FIG. 1 of the waveguide corner.
Figure 3:
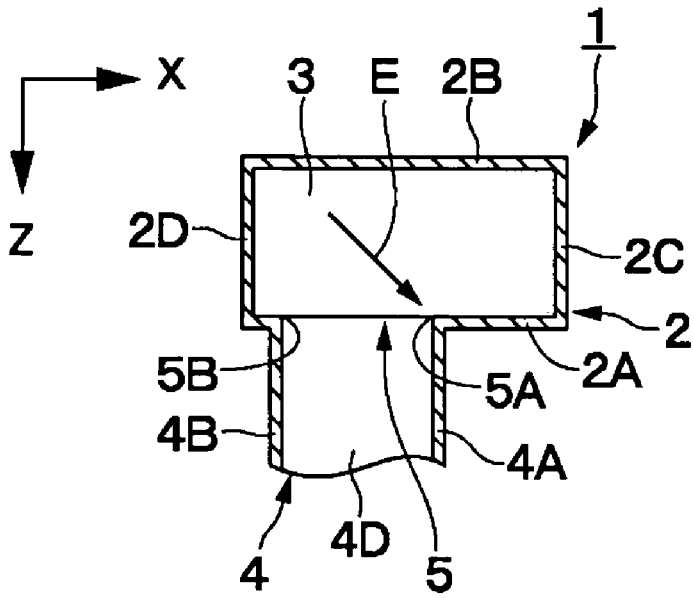
FIG. 3 is a sectional view taken on line III-III of FIG. 2 of the waveguide corner.
Figure 4:
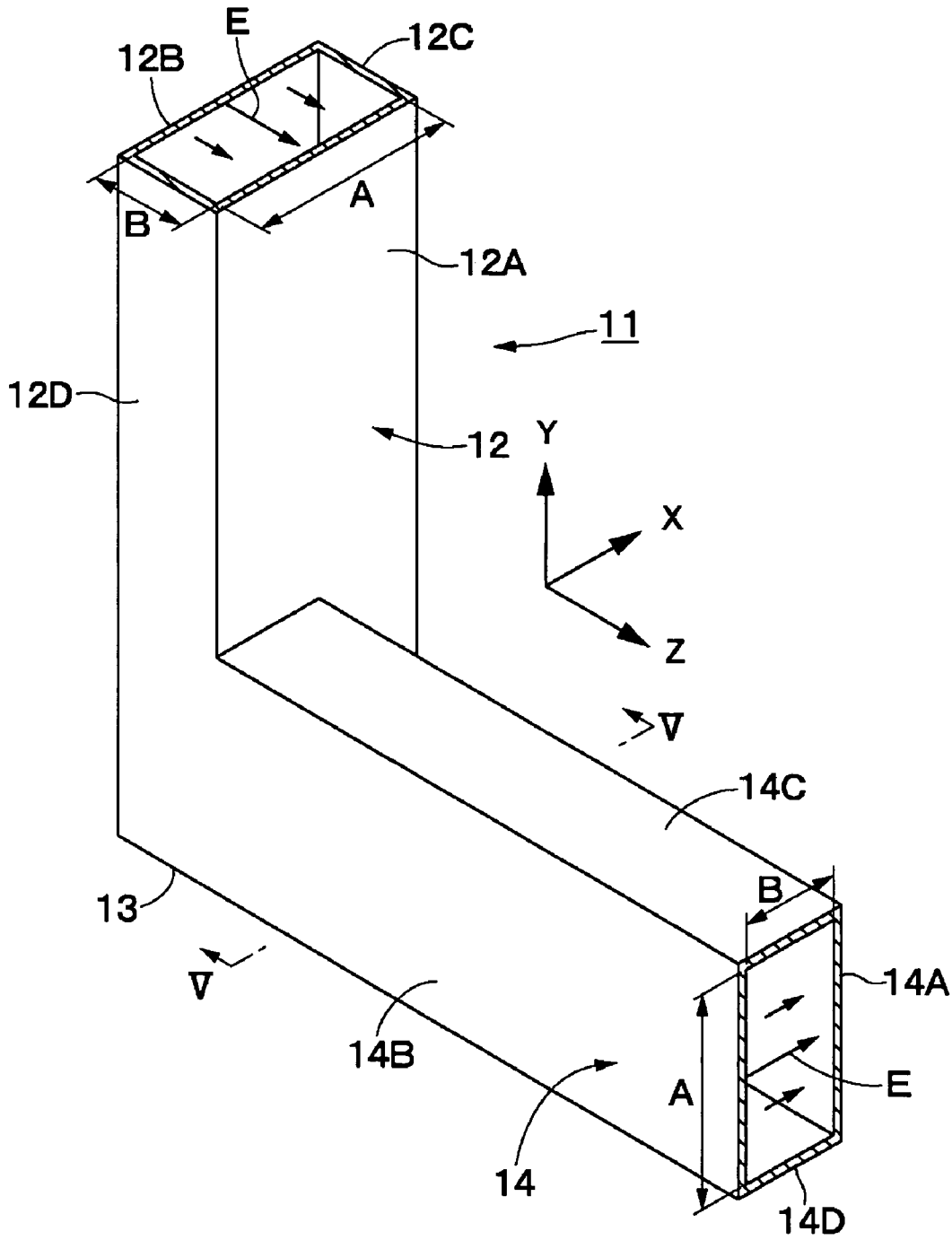
FIG. 4 is a perspective view showing a waveguide corner according to a second embodiment.
Figure 5:
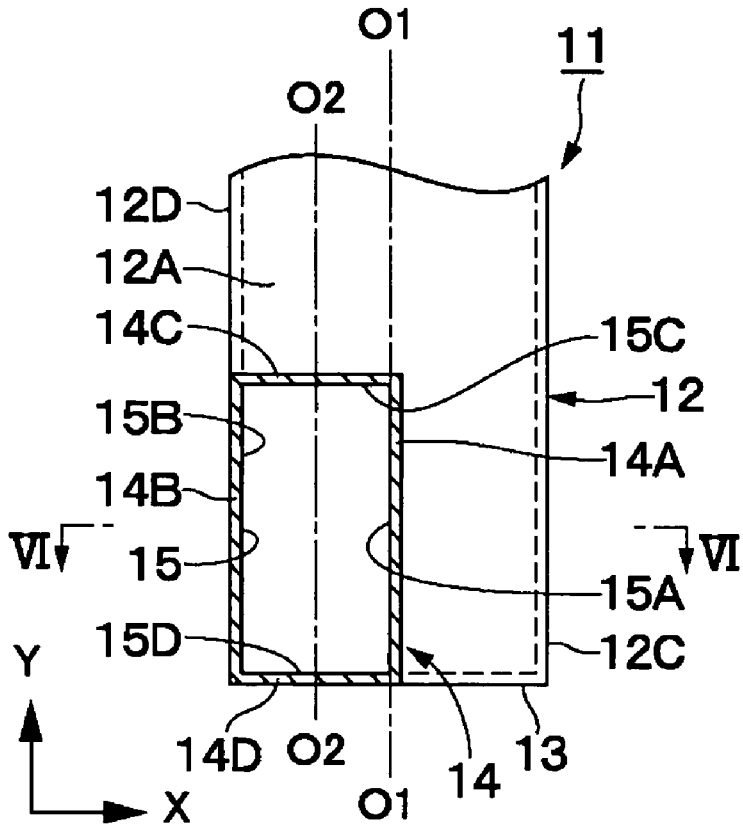
FIG. 5 is a sectional view taken on line V-V of FIG. 4 of the waveguide corner.

First, FIGS. 1 to 3 show a first embodiment. In the drawings, reference numeral 1 denotes a waveguide corner according to the first embodiment. The waveguide corner 1 is composed of two rectangular waveguides 2 and 4 to be described later, and these rectangular waveguides 2 and 4 are connected in a bent state.

Reference numeral 2 denotes a first rectangular waveguide (H-plane waveguide) consisting of a rectangular hollow conductor pipe in which the pipe axis extends in a Y-axis direction, for example. The rectangular waveguide 2 is formed so as to be rectangular in section by a pair of H-plane walls 2A and 2B having a long longitudinal dimension (dimension in the X-axis direction) perpendicular to the pipe axis and E-plane walls 2C and 2D having a short transverse dimension (dimension in the Z-axis direction) perpendicular to the pipe axis and positioned at both ends of the H-plane walls 2A and 2B for connecting the pair of H-plane walls 2A and 2B. Here, the H-plane walls 2A and 2B extend in the X-axis direction which is a direction parallel to the inside magnetic field and form the long sides of the rectangular section. On the other hand, the E-plane walls 2C and 2D extend in the Z-axis direction which is a direction parallel to the inside electric field and form the short sides of the rectangular section. Furthermore, the end in the Y-axis direction of the rectangular waveguide 2 is closed by one end wall 3 made up of a conductor plate. Then, an electric field E (electric field vector) parallel to Z axis is formed inside the rectangular waveguide 2 and an electromagnetic wave (for example, a high-frequency signal of microwave, millimeter wave, etc.) of TE10 mode, for example, is propagated along the pipe axis (Y-axis direction). Then, in an area where the two rectangular waveguides 2 and 4 overlap in the vicinity of the central axis O1 positioned at the center in the X-axis direction (width direction) in the H-plane walls 2A and 2B, an electric field E is directed so as to be perpendicular to the side 5A of an opening 5 to be descried later.

Reference numeral 4 denotes a second rectangular waveguide (E-plane waveguide) consisting of a rectangular hollow conductor pipe in which the pipe axis extends in the Z-axis direction. The second rectangular waveguide 4 is formed so as to be rectangular in section by a pair of H-plane walls 4A and 4B having a long longitudinal dimension (dimension in the Y-axis direction) perpendicular to the pipe axis and E-pane walls 4C and 4D having a short transverse direction (dimension in the X-axis direction) perpendicular to the pipe axis and positioned at both ends of the H-plane walls 4A and 4B for connecting the pair of H-plane walls 4A and 4B, substantially in the same way as the first rectangular waveguide 2.

Furthermore, the end face of the rectangular waveguide 4 is made open to the H-plane wall 2A of the rectangular waveguide 2. At this time, in the H-plane wall 2A of the rectangular waveguide 2, a rectangular opening 5 substantially the same as the section of the rectangular waveguide 4 is formed. The opening 5 has four sides 5A to 5D along the walls 4A to 4D and the inner portions of the two rectangular waveguides 2 and 4 are linked through the opening 5.

Furthermore, the H-plane walls 4A and 4B of the second rectangular waveguide 4 extend in the Y-axis direction of the pipe axis of the first rectangular waveguide 2 which is parallel to the inside magnetic field to form the long side of the rectangular section. On the other hand, the E-plane walls 4C and 4D extend in the X-axis direction, which is a direction parallel to the inside electric field, and form the short sides of the rectangular section. Here, the E-plane walls 4C and 4D of the second rectangular waveguide 4 are disposed in such a way that the central axis O2 positioned at the center in the X-axis direction of the E-plane walls 4C and 4D is displaced from the central axis O1 of the H-plane wall 2A of the first rectangular waveguide 2. Thus, one H-plane wall 4A of the second rectangular waveguide 4 is positioned in the vicinity of the central axis O1 of the H-plane wall 2A of the first rectangular waveguide 2, and the other H-plane wall 4B is positioned so as to be separated from the central axis O1 of the H-plane wall 2A of the first rectangular waveguide 2 and close to the E-plane wall 2D.

Then, an electric field E (electric field vector) parallel to X axis is formed inside the rectangular waveguide 4, and an electromagnetic wave of TE01 mode having a plane of polarization perpendicular to TE10 mode, for example, is propagated along the pipe axis (Z-axis direction). At this time, in an area where the two rectangular waveguides 2 and 4 overlap (where the rectangular waveguide 4 is made open to the rectangular waveguide 2), as shown in FIG. 3, an electric field E is directed so as to be positioned in the vicinity of the central axis O1 of the H-plane wall 2A and to be perpendicular to the side 5A along the central axis O1.

The waveguide corner 1 according to the present embodiment has the above-described structure and next, the operation is described.

First, when an electromagnetic wave (microwave, etc.) of TE01 mode having an electric field E parallel to the Z-axis direction is input to the first rectangular waveguide 2, the electromagnetic wave is propagated in the rectangular waveguide 2 and reaches the side of the end terminal where the opening is contained. Then, a part of the electromagnetic wave reaching the end terminal of the rectangular waveguide 2 enters the second rectangular waveguide 4 through the opening 5 and is propagated in the Z-axis direction along the rectangular waveguide 4.

According to the present embodiment, since the end face of the second rectangular waveguide 4 is made open in the H-plane wall 2A of the first rectangular waveguide 2, the second rectangular waveguide 4 can be connected to the H-plane wall 2A of the first rectangular waveguide 2 so as to be rectangular to the H-plane wall 2A, for example. Furthermore, the H-plane walls 4A and 4B and the E-plane walls 4C and 4D of the second rectangular waveguide 4 extend in the Y-axis direction and the X-axis direction perpendicular to the pipe axis (Z-axis direction), respectively. Under such a condition, since the H-plane walls 4A and 4B of the second rectangular waveguide 4 extend along the pipe axis of the first rectangular waveguide 2 (Y-axis direction), the H-plane walls 4A and 4B of the second rectangular waveguide 4 can be extended so as to be perpendicular to the H-plane wall 2A of the first rectangular waveguide 2.

Accordingly, since the plane of polarization of the first rectangular waveguide 2 and the plane of polarization of the second rectangular waveguide 4 can be made to cross at right angles, the waveguide corner 1 is able to have a conversion function of a plane of polarization. Furthermore, since the H-plane walls 2A and 4A of the two rectangular waveguides 2 and 4 form different planes, the second rectangular waveguide 4 can be extended so as to be perpendicular to the H-plane wall 2A of the first rectangular waveguide 2, for example. As a result, when the conversion function of a plane of polarization and the bending direction of the rectangular waveguides 2 and 4 are combined, combinations which do not exist in the H corners and E corners according to the related technology can be realized and the degree of freedom of layout of a waveguide circuit can be increased to make the waveguide circuit smaller.

In particular, in the present embodiment, the central axis O2 of the E-plane walls 4C and 4D of the second rectangular waveguide 4 is displaced from the central axis O1 of the H-plane wall 2A of the first rectangular waveguide 2. At this time, the end face of the second rectangular waveguide 4 is made open to the H-plane wall 2A of the first rectangular waveguide 2. Accordingly, out of the two H-plane walls 4A and 4B forming the second rectangular waveguide 4, the H-plane wall 4A on one side is disposed at a position close to the central axis O1 of the H-plane wall 2A of the first rectangular waveguide 2, and the H-plane wall 4B (remaining) on the other side can be disposed in the vicinity of the E-plane wall 2D separated from the central axis O1 of the H-plane wall 2A of the first rectangular waveguide 2.

In the area where the two rectangular waveguides 2 and 4 overlap, an electric field E is directed to the side 5A close to the central axis O1 of the H-plane wall 2A of the rectangular waveguide 2 out of the four sides 5A to 5D forming the opening 5 of the rectangular waveguide 4 so as to be perpendicular to the side 5A. The direction of the electric field E is a composite direction which is made up of electric fields being propagated in the rectangular waveguides 2 and 4, and thus, the conversion of a plane of polarization becomes possible. As a result, the conversion of a plane of polarization can be performed between the first and second rectangular waveguides 2 and 4 and the electric field components can be made at right angles to each other.

Next, FIGS. 4 to 7 show a second embodiment of the present invention. The second embodiment is characterized in that the H-plane wall of the second rectangular waveguide constitutes the same plane as the E-plane wall of the first rectangular waveguide.

Reference numeral 11 denotes a waveguide corner according to the second embodiment. The waveguide corner 11 includes rectangular waveguides 12 and 14 to be described later, and the rectangular waveguides 12 and 14 are connected in a bent state.

Reference numeral 12 denotes a first rectangular waveguide (H-plane waveguide) consisting of a rectangular hollow conductor pipe in which the pipe axis extends in the Y-axis direction, for example. The rectangular waveguide 12 is formed so as to be rectangular in section by a pair of H-plane walls 12A and 12B, opposite to each other, having a long longitudinal dimension (dimension in the X-axis direction) perpendicular to the pipe axis and E-plane walls 12C and 12D having a short transverse dimension (dimension in the Z-axis direction) and positioned at both ends of the H-plane walls 12A and 12B for connecting the pair of H-plane walls 12A and 12B, perpendicular to the pipe axis, substantially in the same way as the rectangular waveguide 2 according to the first embodiment.

Here, the H-plane walls 12A and 12B form the long sides of a rectangular section in such a way that the H-plane walls extend in the X-axis direction parallel to the inside magnetic field. On the other hand, the E-plane walls 12C and 12D form the short sides of the rectangular section in such a way that the E-plane walls extend in the Z-axis direction parallel to the inside electric field. Furthermore, the end in the Y-axis direction of the rectangular waveguide 12 is closed by an end wall 13 made up of a conductor plate. Then, an electric field E (electric field vector) parallel to Z-axis is formed inside the rectangular waveguide 12, and, for example, an electromagnetic wave of TE10 mode is propagated along the pipe axis (Y-axis direction).

Reference numeral 14 denotes a second rectangular waveguide (E-plane waveguide) consisting of a rectangular hollow conductor pipe in which the pipe axis extends in the Z-axis direction. The rectangular waveguide 14 is formed so as to be rectangular in section by a pair of H-plane walls 14A and 14B, opposite to each other, having a long longitudinal dimension (dimension in the Y-axis direction) perpendicular to the pipe axis and E-plane walls 14C and 14D having a short transverse dimension (dimension in the X-axis direction) perpendicular to the pipe axis and positioned at both ends of the H-plane walls 14A and 14B for connecting the pair of the H-plane walls 14A and 14B, substantially in the same way as the rectangular waveguide 4 according to the first embodiment.

Furthermore, the end face in the Z-axis direction of the rectangular waveguide 14 is made open to the H-plane wall 12A of the rectangular waveguide 12. At this time, a rectangular opening 15 being substantially the same as the section of the rectangular waveguide 14 is formed in a corner portion of the H-plane wall 12A of the rectangular waveguide 12. Then, the opening 15 contains four sides 15A to 15D along the walls 14A to 14D and the inside of the two rectangular waveguides 12 and 14 is linked through the opening 15.

Furthermore, the H-plane walls 14A to 14B of the second rectangular waveguide 14 extend along the Y-axis direction being the pipe axis of the first rectangular waveguide 12 parallel to the inside magnetic field to form the long sides of a rectangular section. On the other hand, the E-plane walls 14C and 14D extend in the X-axis direction being parallel to the inside electric field to form the short sides of the rectangular section.

Here, the E-plane walls 14C and 14D of the second rectangular waveguide 14 are disposed in such a way that the central axis O2 positioned at the center in the X-axis direction of the E-plane walls 14C and 14D is displaced from the central axis O1 of the H-plane wall 12A of the first rectangular waveguide 12. Furthermore, out of the two H-plane walls 14A and 14B of the second rectangular waveguide 14, one H-plane wall 14A is positioned in the vicinity of the central axis O1 of the H-plane wall 12A of the first rectangular waveguide 12, and the other H-plane wall 14B is continuous with one E-plane wall 12D out of the two E-plane walls 12C and 12D of the first rectangular waveguide 12 to form the same plane.

Then, inside the rectangular waveguide 14, an electric field E (electric field vector) parallel to X axis is formed and an electromagnetic wave of TE01 mode having a plane of polarization perpendicular to TE01 mode, for example, is propagated along the pipe axis (Z-axis direction).

Thus, the same operation-effect as in the first embodiment can be also obtained in the present embodiment. In particular, in the present embodiment, the H-plane wall 14B of the second rectangular waveguide 14 is formed so as to have the same plane as the E-plane wall 12D of the first rectangular waveguide 12. Accordingly, the H-plane wall 14B of the second rectangular waveguide 14 and the E-plane wall 12D of the first rectangular waveguide 12 can be formed at the same time. As a result, the waveguide corner 11 can be molded and processed by using various molding methods such as cutting operation of metal, injection molding, press operation, etc., for example, and the moldability, productivity, and mass production efficiency can be increased.

Figure 6:
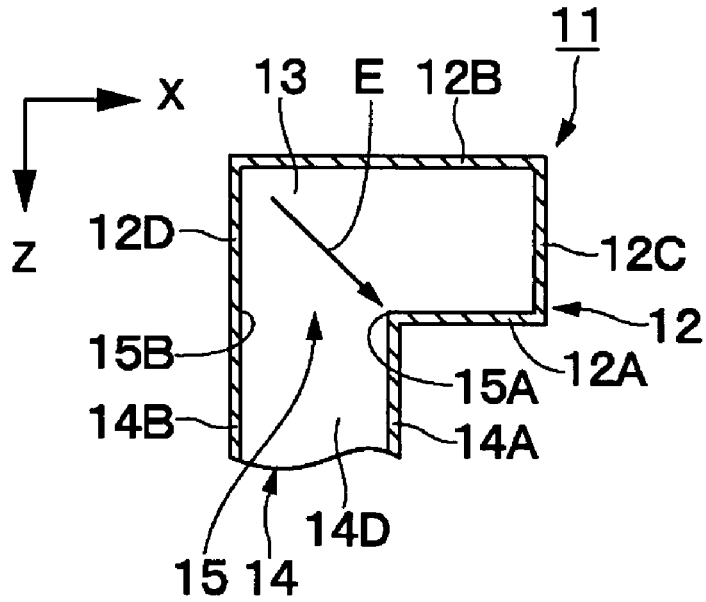
FIG. 6 is a sectional view taken on line VI-VI of FIG. 5 of the waveguide corner.

Furthermore, since the H-plane wall 14B of the second rectangular waveguide 14 is figured to have the same plane as the E-plane wall 12D of the first rectangular waveguide 12, the H-plane wall 14B of the second rectangular waveguide 14 can be made continuous with the E-plane wall 12D of the first rectangular waveguide 12 and the rest of the H-plane 14A of the second rectangular waveguide 14 can be disposed so as to be close to the central axis O1 of the H-plane wall 12A of the rectangular waveguide 12. At this time, in an area where the two rectangular waveguides 12 and 14 overlap (area where the rectangular waveguide 14 is made open to the rectangular waveguide 12), as shown in FIG. 6, an electric field E is directed so as to be perpendicular to the side 15A (edge portion) close to the central axis O1 of the H-plane wall 12A of the rectangular waveguide 12 out of the four sides 15A to 15D forming the opening 15 of the rectangular waveguide 14. The direction of the electric field E is in agreement with a composite direction of the electric fields E being propagated in the rectangular waveguides 12 and 14, and thus, the conversion of a plane of polarization becomes possible. As a result, a plane of polarization can be converted between the first rectangular waveguide 12 and the second rectangular waveguide 14 and the electric field components can be at right angles to each other.

In particular, in general rectangular waveguides (for example, WR-10, etc.), the longitudinal dimension A on the side of the long side (side of the H-plane wall) in a rectangular opening is set to be double the transverse dimension B on the side of the short side (side of the E-plane wall) (A=2×B). When such a general rectangular waveguide is applied to the rectangular waveguides 12 and 14 according to the present embodiment, since, out of the two H-plane walls 14A and 14B of the second rectangular waveguide 14, the H-plane wall 14B is made continuous with the E-plane wall 12D of the first rectangular waveguide 12 to form the same plane, the H-plane wall 14A of the rest is disposed on the central axis O1 in the H-plane wall 12A of the first rectangular waveguide 12. At this time, since an electromagnetic wave of TE10 mode is propagated inside the first rectangular waveguide 12, an electric field vector at an edge portion (portion of the side 15A) is directed so as to be perpendicular to the edge portion. Accordingly, since a vector direction around the edge portion becomes a composite vector of the electric field vectors relating to the H-plane wall 14B and the E-plane wall 12D connected to each other, the mode conversion between the first and second rectangular waveguides 12 and 14 becomes possible and at the same time, the reflection loss is reduced.

Figure 7:
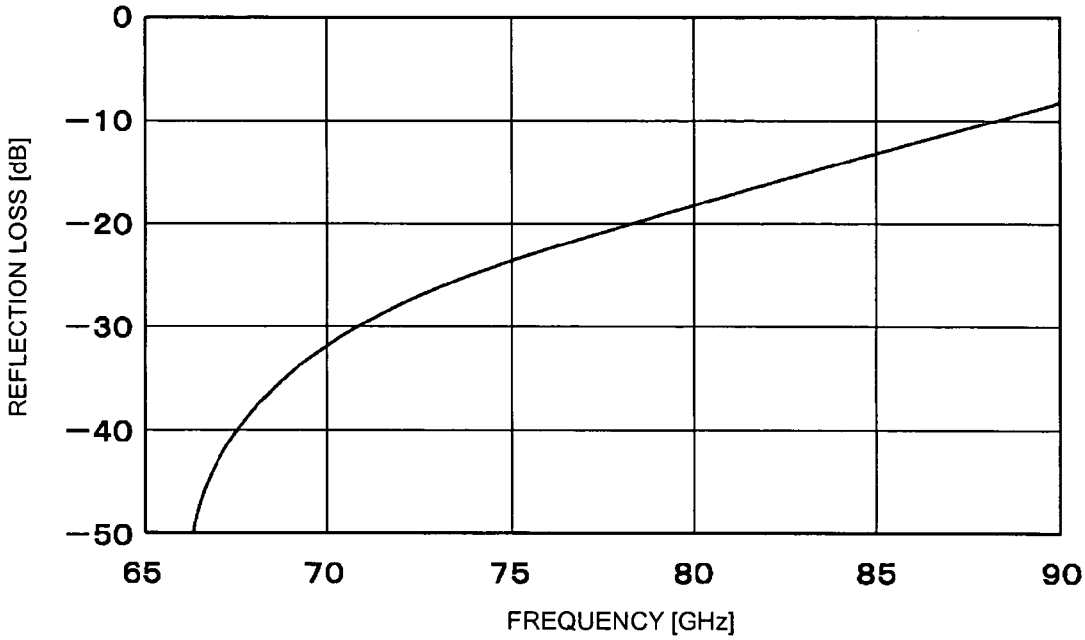
FIG. 7 is a diagram showing frequency characteristics of reflection loss of the waveguide corner in FIG. 4.
Figure 8:
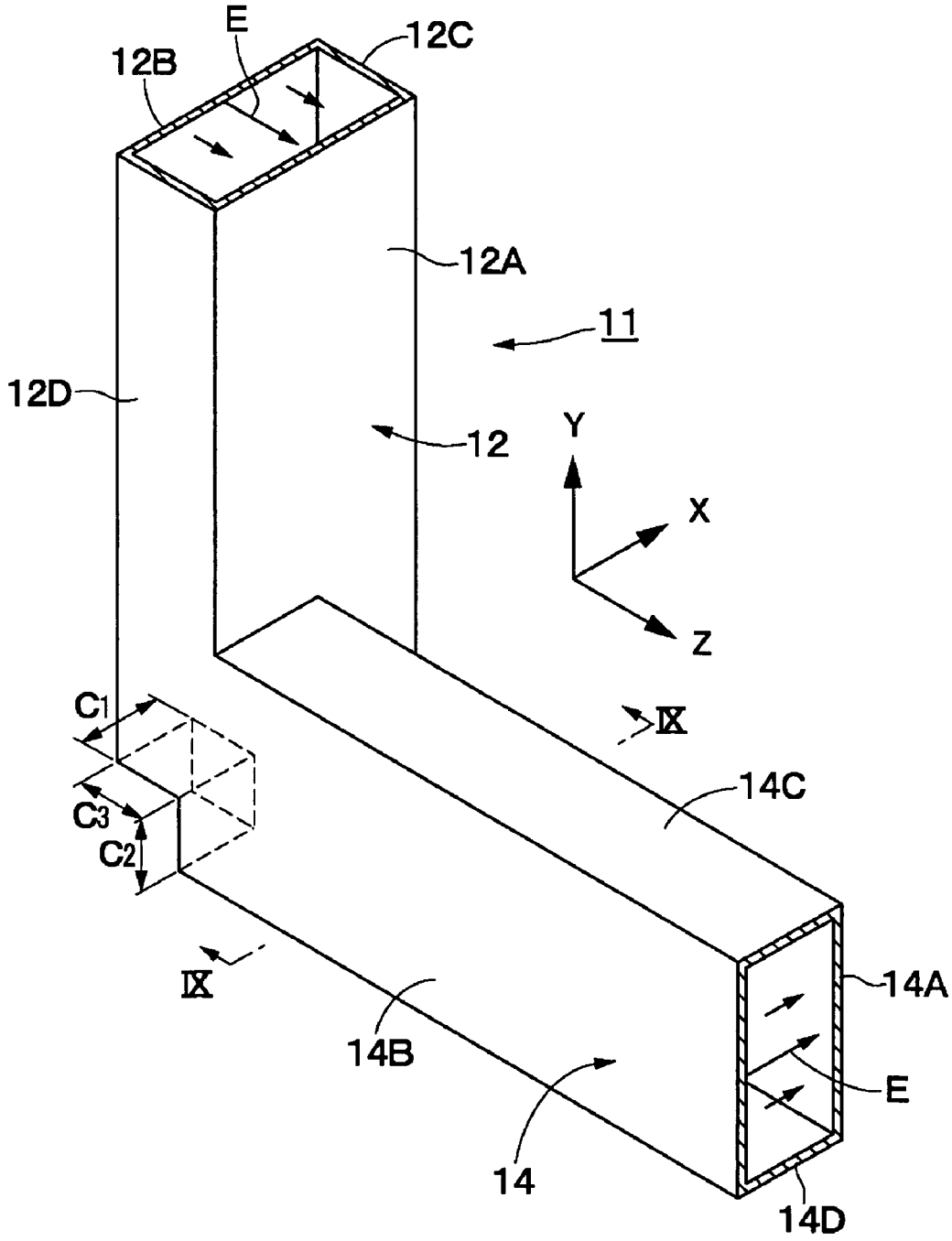
FIG. 8 is a perspective view showing a waveguide corner according to a third embodiment.
Figure 9:
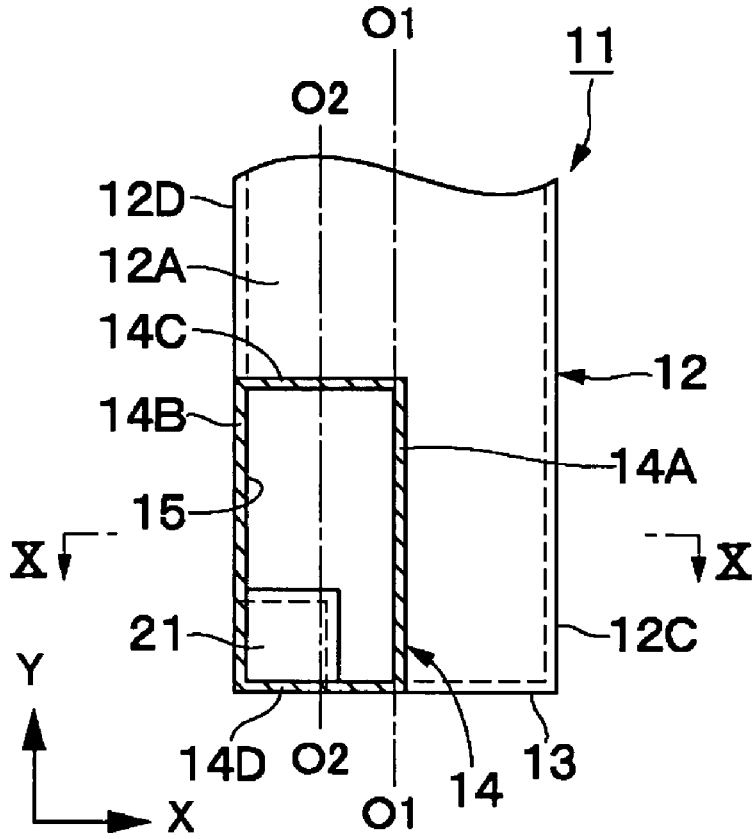
FIG. 9 is a sectional view taken on line IX-IX of FIG. 8 of the waveguide corner.
Figure 10:
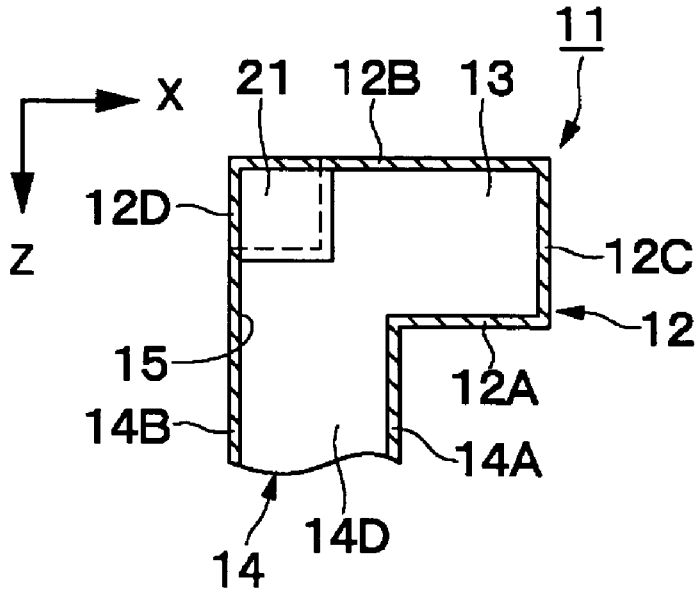
FIG. 10 is a sectional view taken on line X-X of FIG. 9 of the waveguide corner.

FIG. 7 shows the reflection loss of the waveguide corner 11. A case in which a normal rectangular waveguide WR-10 is used for the first and second rectangular waveguides 12 and 14 is assumed, and the reflection loss in this case is calculated by using an electromagnetic field simulation, etc. The result is shown in FIG. 7. Moreover, regarding the rectangular opening of the first and second rectangular waveguides 12 and 14, the longitudinal dimension A of the long side is 2.54 mm and the transverse dimension B of the short side is set to be 1.27 mm. From the result in FIG. 7, the reflection loss can be reduced so as to be less than −15 dB in a frequency band of 73 GHz or less, and, while the loss is reduced between the first and second rectangular waveguides 12 and 14, it was confirmed that the transmission of an electromagnetic wave accompanied by mode conversion becomes possible.

Next, FIGS. 8 to 11 shows a third embodiment of the present invention. The third embodiment is characterized in that a matching waveguide element is provided in the first rectangular waveguide. The matching waveguide element is positioned in the vicinity of the open end face of the second rectangular waveguide so as to match electromagnetic modes in the two rectangular waveguides each other. In the third embodiment, the same reference numeral is given to the same element as in the second embodiment and the description is omitted.

Reference numeral 21 (FIGS. 9 and 10) denotes a conductor protrusion portion as a matching waveguide element contained on the end side of the first rectangular waveguide 12. The conductor protrusion portion 21 is formed by the same conductor material (conductive material) as the walls 12A to 12D, for example, and is formed in the vicinity of the opening 15, the open end face of the second rectangular waveguide 14, i.e., at a corner where the E-plane wall 12D, the end wall 13, and the H-plane wall 12B join. Then, the conductor protrusion portion 21 is substantially in the form of a rectangular parallelepiped and protruded inside the rectangular waveguide 12. Thus, since an electric field is concentrated on the side of the protruded end of the conductor protrusion portion 21, the mode conversion is easily performed between the first and second rectangular waveguides 12 and 14 and the matching band can be widened.

Figure 11:
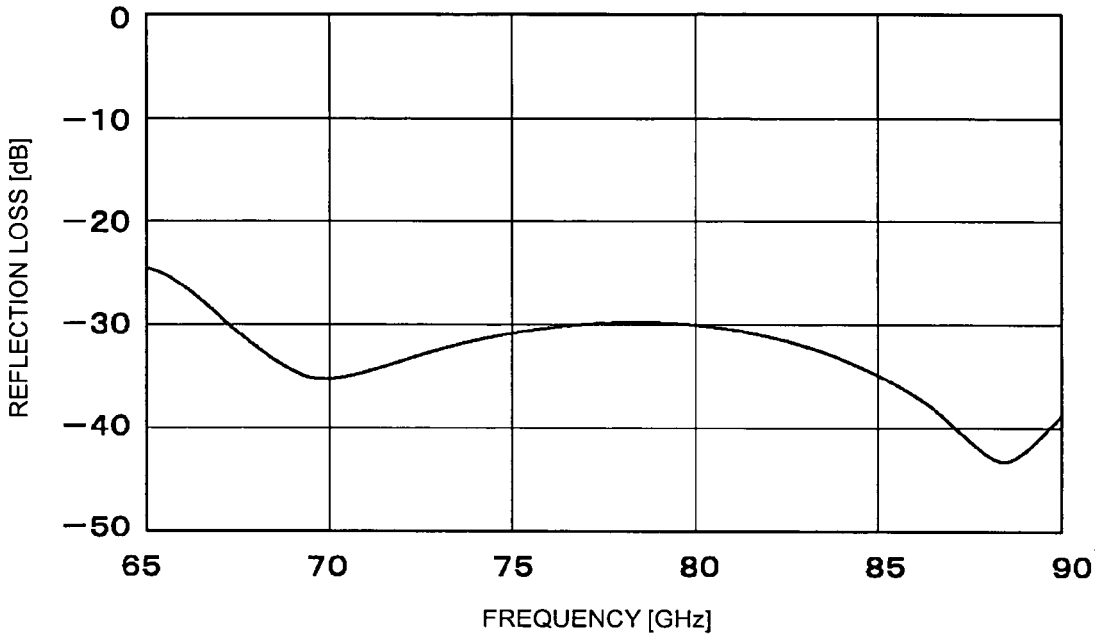
FIG. 11 is a diagram showing frequency characteristics of reflection loss of the waveguide corner in FIG. 8.

FIG. 11 shows the effect of the conductor protrusion portion 21. A case in which a normal rectangular waveguide WR-10 is used for the first and second rectangular waveguides 12 and 14 is assumed, and the reflection loss in this case is calculated by using an electromagnetic field simulation, etc. The result is shown in FIG. 11. Regarding the rectangular opening of the first and second rectangular waveguides 12 and 14, the longitudinal dimension A of the long side is 2.54 mm and the transverse dimension D of the short side is set to be 1.27 mm. Furthermore, the dimension C1 in the X-axis direction, the dimension C2 in the Y-axis direction, and the C3 dimension in the Z-axis direction of the conductor protrusion portion 21 are made 0.80 mm (C1=0.80 mm), 0.80 mm (C2=0.80 mm), and 0.90 mm (C3=0.90 mm). From the result of FIG. 11, the reflection loss can be reduced so as to be less than −15 dB in a frequency range of 65 to 90 GHz, and it is understood that the matching band can be made wider in comparison with the case where the conductor protrusion portion 21 is not contained (see FIG. 7).

Thus, in the third embodiment, the same operation-effect as in the first and second embodiments can be obtained. In particular, in the third embodiment, the conductor protrusion portion 21 is formed inside the first rectangular waveguide 12 so as to be positioned in the vicinity of the open end face (opening 15) of the second rectangular waveguide 14. Accordingly, the matching between a TE10 mode being propagated in the first rectangular waveguide 12 and a TE10 mode being propagated in the second rectangular waveguide 14 can be improved because an electric field is concentrated at the tip side of the conductor protrusion portion 21, for example. Thus, the reflection loss between the two rectangular waveguides 12 and 14 can be decreased and the matching frequency band is wider.

Furthermore, since the matching waveguide element is constituted by the conductor protrusion portion 21 protruded inside the first rectangular waveguide 12, the conductor protrusion portion 21 can be formed simultaneously when the walls 12A to 12D of the first rectangular waveguide 12, etc., are processed and, as a result, the processability and the efficiency of mass production can be increased.

In the above-described third embodiment, the conductor protrusion portion 21 is used as a matching waveguide element. However, the present invention is not limited to this and, for example, a metal bolt protruded inside the first rectangular waveguide 12, etc., for example, may be used as a matching waveguide element. In this case, the adjustment of matching, etc., becomes possible by properly changing the protruded dimension of the bolt.

Figure 12:
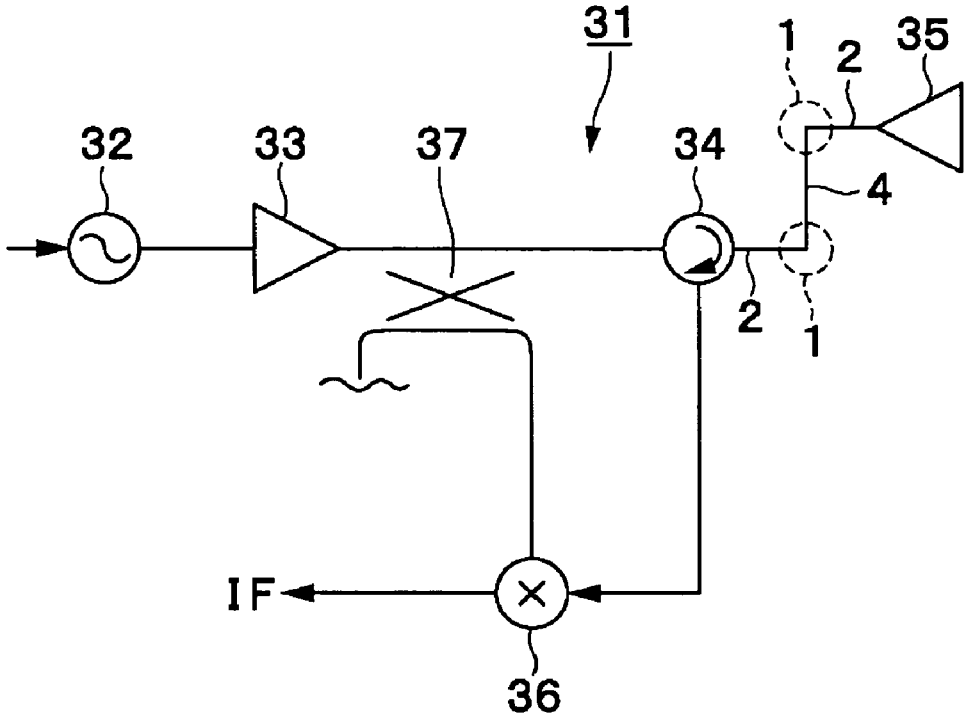
FIG. 12 is a block diagram showing a radar device according to a fourth embodiment.

Next, FIG. 12 shows a fourth embodiment of the present invention. The fourth embodiment is characterized in that a radar device as a radio device is formed using a waveguide corner of the present invention. Moreover, in the fourth embodiment, the same reference numeral is given to the same element as in the first embodiment and the description is omitted.

Reference numeral 31 denotes a radar device as a radio device according to the fourth embodiment. The radar device 31 contains voltage-controlled oscillator 32, an antenna 35 (radiator) connected to the voltage-controlled oscillator 32 through an amplifier 33 and a circulator 34, and a mixer 36 connected to the circulator 34 for downconverting a signal received from the antenna 35 to an intermediate-frequency signal IF. Furthermore, a directional coupler 37 is connected between the amplifier 33 and the circulator 34. Then, a signal power-distributed by the directional coupler 37 is input to the mixer 36 as a local signal. Furthermore, the circulator 34 and the antenna 35 are connected by rectangular waveguides 2 and 4 and a waveguide corner 1 is contained in the bent portion between the rectangular waveguides 2 and 4.

The radar device 31 according to the present embodiment has the above-described structure. An oscillation signal output from the voltage-controlled oscillator 32 is amplified by the amplifier 33, and passes through the directional coupler 37 and the circulator 34 and is transmitted (radiated) as a transmission signal from the antenna 35. On the other hand, a reception signal received through the antenna is input to the mixer 36 through the circulator 34 and downconverted to be output as an intermediate-frequency signal by using a local signal from the directional coupler 37.

Thus, according to the fourth embodiment, since the radar device 31 is formed by using a waveguide corner 1, the freedom of layout of the radar device 31 is increased by application of the waveguide corner 1 in which the conversion (mode change) of a plane of polarization can be performed at the connection portion of the antenna 35, etc., and at the same time, the device can be made smaller as a whole.

Moreover, in the above-described fourth embodiment, although the case in which a waveguide corner 1 of the present invention is applied to the radar device 31 is described as an example, the waveguide corner 1 may be applied to a communication device as a radio device, etc., for example.

Furthermore, in the fourth embodiment, although a waveguide corner 1 according to the first embodiment is used, waveguide corners 11 according to the second and third embodiments may be used.

Figure 13:
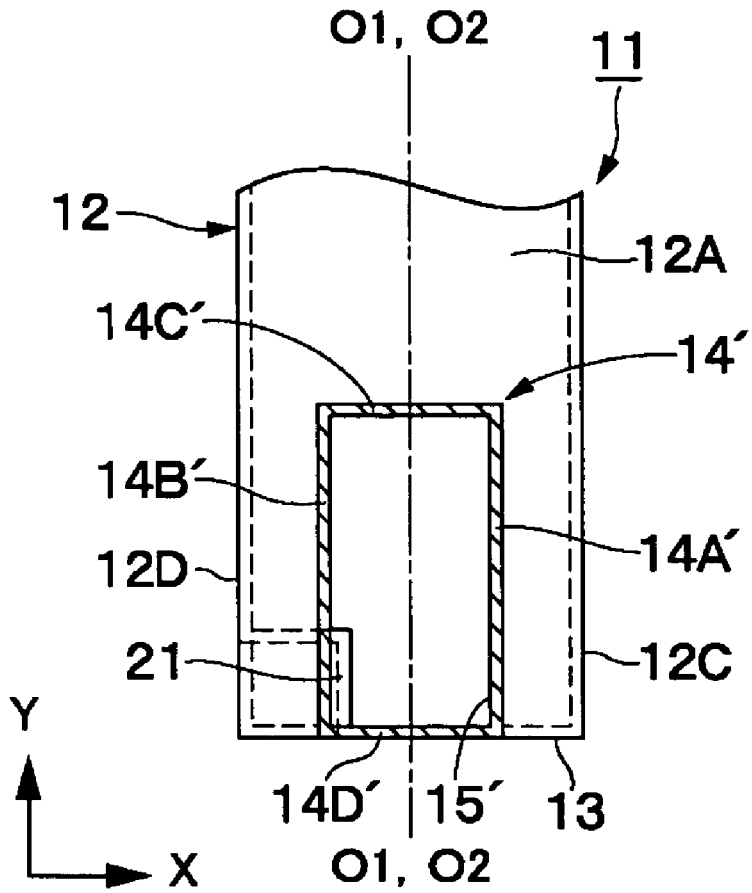
FIG. 13 is a sectional view of a waveguide corner according to a first modified example when taken from the same position as in FIG. 2.

Furthermore, in each embodiment, the central axis O2 of the E-plane walls 4C, 4D, 14C, and 14D of the second rectangular waveguides 4 and 14 is displaced from the central axis O1 of the H-plane walls 2A and 12A of the first rectangular waveguides 2 and 12. However, the present invention is not limited to these and, for example, like a first modified example shown in FIG. 13, the central axis O2 of the E-plane walls 14C' and 14D' of a second rectangular waveguide 14' may be made in agreement with the central axis O1 of the H-plane wall 12A of the first rectangular waveguide 12. In this case, in the same way as in the third embodiment, the conductor protrusion portion 21 as a matching waveguide element is formed inside the first rectangular waveguide 12 and the mode conversion are performed between the rectangular waveguides 12 and 14'.

Figure 14:
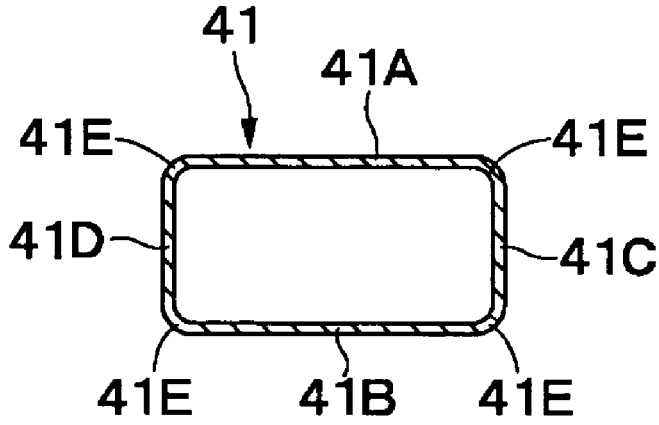
FIG. 14 is a sectional view showing a waveguide according to a second modified example.

Furthermore, in each embodiment, the rectangular waveguides 2, 4, 12, and 14 having a rectangular section are used as a waveguide. However, the present invention is not limited to these and, for example, like a second modified example shown in FIG. 14, a waveguide 41 made up of first walls 41A and 41B and second walls 41C and 41D having substantially rectangular section in which chamfers 41E, such as rounded chamfers and plane chamfers with chamfered corner and chamfered edge are formed may be used.

Figure 15:
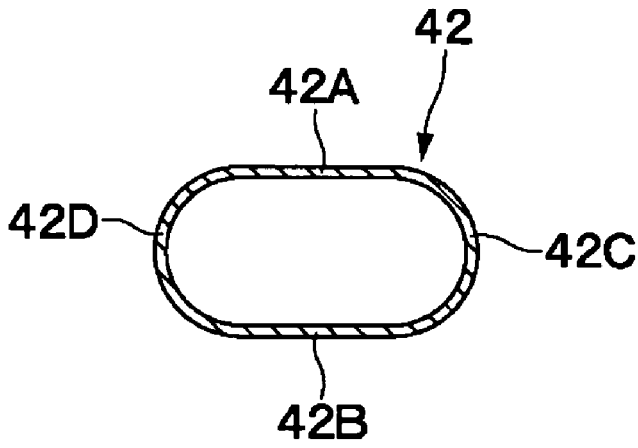
FIG. 15 is a sectional view showing a waveguide according to a third modified example.

Furthermore, like a third modified example shown in FIG. 15, a waveguide 42 in which second walls 42C and 42D forming a substantially circular arc are contained on both sides of flat first walls 42A and 42B, opposite to each other, and which has a substantially elliptical section may be used.

Figure 16:
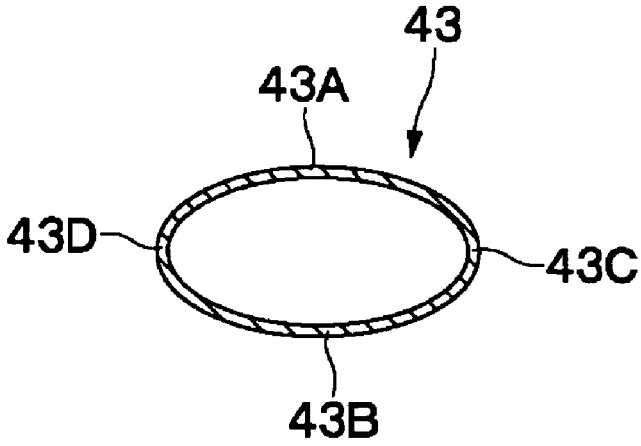
FIG. 16 is a sectional view showing a waveguide according to a fourth modified example.

Moreover, like a fourth modified example shown in FIG. 16, a waveguide 43 in which a substantially elliptical section is formed by first walls 43A and 43B extending in the direction of the long axis and second walls 43C and 43D extending in the direction of the short axis may be used.

Furthermore, in each embodiment, although the inside of the rectangular waveguides 2, 4, 12, and 14 is made hollow, a waveguide into which a dielectric material is loaded (inserted), for example, may be used.

Furthermore, in each embodiment, although the second rectangular waveguides 4 and 14 are extended so as to be perpendicular to the H-plane walls 2A and 12A of the first rectangular waveguides 2 and 12, the second rectangular waveguides 4 and 14 may be extended in a direction tilted from the perpendicular direction.

The invention claimed is:

1. A waveguide corner comprising:

a first waveguide having a first pipe axis, the first waveguide including:

a pair of opposing first walls, the pair of opposing first walls having a longitudinal dimension perpendicular to the first pipe axis, a pair of opposing second walls having a transverse dimension perpendicular to the first pipe axis, the pair of second walls positioned at respective ends of the pair of first walls and connecting the pair of first walls, and an end wall extending between the pair of opposing first walls and the pair of opposing second walls so as to close one end of the first waveguide; and a second waveguide having a second pipe axis and connected to the first waveguide in a bent state, the second waveguide including:

a pair of opposing third walls having a longitudinal dimension perpendicular to the second pipe axis, and a pair of opposing fourth walls having a transverse dimension perpendicular to the second pipe axis, the pair of fourth walls positioned at respective ends of the pair of third walls and connecting the pair of third walls, wherein an end face of the second waveguide is open to one of the first walls of the first waveguide, wherein one of the third walls of the second waveguide extends along the first pipe axis of the first waveguide, wherein one of the third walls of the second waveguide is in the same plane as one of the second walls of the first waveguide, wherein one of the fourth walls of the second waveguide is in the same plane as the end wall of the first waveguide, and wherein the waveguide corner is configured so as to propagate a signal from the first waveguide to the second waveguide without a step between the first waveguide and the second waveguide.

2. The waveguide corner as claimed in claim 1, wherein each of the first and second waveguides are rectangular waveguides, the first and third walls being H-plane walls parallel to a magnetic field and the second and fourth walls being E-plane walls parallel to an electric field.

3. The waveguide corner as claimed in claim 2, wherein a central axis of the E-plane walls of the second rectangular waveguide is displaced from a central axis of the H-plane walls of the first rectangular waveguide.

4. The waveguide corner as claimed in claim 2, wherein one of the H-plane walls of the second rectangular waveguide is in the same plane as one of the E-plane walls of the first rectangular waveguide.

5. A radio device comprising a waveguide corner as claimed in claim 1.

6. The waveguide corner as claimed in claim 1, wherein the second pipe axis of the second waveguide is displaced from the first pipe axis of the first waveguide.

7. The waveguide corner as claimed in claim 1, wherein at least one of the first and second waveguides have chamfered corners.

8. The waveguide corner as claimed in claim 1, wherein the second waveguide is connected to the first waveguide such that the first pipe axis and the second pipe axis are perpendicular to each other.

* * * * *